US005682871A

United States Patent [19]

Walk et al.

[11] Patent Number: 5,682,871

[45] Date of Patent: Nov. 4, 1997

[54] ARCHERY BOW RISER

[75] Inventors: Randy J. Walk, Tooele; William M. Boynton, Layton, both of Utah

[73] Assignee: Hoyt USA, Salt Lake City, Utah

[21] Appl. No.: 596,431

[22] Filed: Feb. 2, 1996

[51] Int. Cl.[6] ..... F41B 5/00

[52] U.S. Cl. ..... 124/88; 124/24.1

[58] Field of Search ..... D22/107; 124/23.1, 124/24.1, 25.6, 44.5, 86, 88

[56] References Cited

U.S. PATENT DOCUMENTS

| | | | |
|---|---|---|---|
| D. 227,098 | 6/1973 | Wilson et al. | D22/107 |
| 2,736,309 | 2/1956 | Hoffman | 124/23.1 |
| 2,743,716 | 5/1956 | Wendt | 124/24.1 X |
| 3,397,685 | 8/1968 | Walker | 124/23.1 X |
| 3,923,035 | 12/1975 | Trotter | 124/25.6 |
| 3,923,036 | 12/1975 | Jennings et al. | 124/88 |
| 4,971,020 | 11/1990 | Soderstrom et al. | 124/23.1 |
| 5,099,819 | 3/1992 | Simonds et al. | 124/23.1 |

*Primary Examiner*—John A. Ricci

*Attorney, Agent, or Firm*—Mallinckrodt & Mallinckrodt

[57] ABSTRACT

An archery bow riser includes a main riser section and a reinforcing riser section joined to the ends of the main riser section and spaced from the main riser section toward the bow string. Interconnecting members extend between the main and reinforcing riser sections intermediate their lengths so that each section reinforces the other to provide a strong and rigid riser. One interconnecting member preferably constitutes an extension of the lower portion of the sight window and the arrow shelf from the main riser section to the reinforcing riser section to form a built-in overdraw for the riser. The cable guide is mounted on the reinforcing riser section and is vertically positioned closer to the center of the riser than is possible with conventional risers.

15 Claims, 3 Drawing Sheets

ARCHERY BOW RISER

BACKGROUND OF THE INVENTION

1. Field

The invention is in the field of archery bow risers.

2. State of the Art

Archery bow risers provide a central body portion for an archery bow and include a handle for holding the bow, the sight window through which the arrow is shot from the bow, provides for attachment of accessories such as arrow rests, sights, cable guards, and stabilizers, and provides for attachment of the bow limbs at opposite ends of the riser. The energy produced by a bow is obtained by bending the limbs of the bow. Modern bows are designed to store large amounts of energy. The bow riser, which secures and holds the limbs, is subject to and must be designed to withstand the extreme stresses that are placed on the bow when the bow is drawn. While many older bows included wood risers, most currently available bows include risers made of a metal such as aluminum or magnesium. These metals are used because they are relatively light for the strength they provide. Such risers are usually machined or cast.

It is generally desirable to make an archery bow as light as possible to make it easier to carry. However, the riser has to be strong enough to withstand the extreme stresses applied to it when the bow is drawn, and for this reason, it is difficult to reduce the mass and weight of a riser.

Most risers include a sight window through which an arrow is shot and an arrow shelf at the bottom of the sight window. Originally, the arrow shelf supported an arrow as the bow was aimed, but most archers currently use arrow rests attached to the riser which hold the arrow above the arrow shelf. The arrow shelf remains, however, as a safety feature to catch and hold the end of an arrow if it slips off of the arrow rest. It catches the end of the arrow and prevents it, with any attached broadhead, from falling onto the hand or arm of the archer holding the bow.

An archer generally selects an arrow of length such that at the normal full draw of the archer, the forward end of the arrow adjacent the broadhead or other arrow tip is resting on the arrow rest. An archer does not want an arrow that extends substantially beyond the rest. Further, in many instances an archer prefers a shorter arrow. It is common in many cases for an archer to attach an "overdraw" to the riser of the bow to extend the mounting for the arrow rest toward the archer to thereby reduce the distance between the arrow rest and the bow string at full draw and allow use of a shorter arrow than would otherwise be the case. The overdraw also extends the arrow shelf toward the archer so the shelf extends under the arrow rest and under the tip of the arrow. The overdraw is attached to the bow riser so adds additional weight to the riser. Most overdraws will add at least about five ounces of weight. Further, since the overdraw is a separate piece attached to the riser, it causes undesirable noise, vibration, and movement when a bow is shot.

Most bows also include a cable guide extending from the riser toward the archer and displaced laterally from the bow string. A slide holds the cables laterally away from the bow string so that an arrow shot from the bow will not hit the cables when shot. The cable guide is generally secured to the riser below the hand grip. However, the closer the cable guide can be placed to the center of the bow, i.e., the location of an arrow when it is shot from the bow, the less lateral displacement of the string is necessary to provide a given desired displacement at the center of the bow. However, the hand grip generally dictates the distance away from the center the cable guide can be mounted.

SUMMARY OF THE INVENTION

According to the invention, an archery bow riser is formed with a main riser section and a reinforcing riser section spaced toward the archer from the main riser section. The main riser section and reinforcing riser section are attached at the opposite riser ends, and are attached intermediate the riser ends so that the riser sections reinforce one another. It is preferred that an intermediate attachment of the main riser section and the reinforcing riser section be in the area of the sight window and arrow shelf and form an extension of the arrow shelf and lower portion of the sight window adjacent the arrow shelf to, in effect, form a built in overdraw. This eliminates the need to attach a separate overdraw to the riser and thereby avoids the noise, vibration, and movement of a separate overdraw attachment. Further, it has been found that such a riser can be made lighter than the normal combination of standard riser and attached overdraw, while providing a riser of at least comparable strength and rigidity.

The hand grip portion of the riser remains on the main riser section positioned as with a conventional riser. The reinforcing riser section will be laterally offset from the handle portion of the main riser section to an extent necessary to allow an archer to hold the riser in normal manner. With the reinforcing riser section separate from the handle portion, the normal compound bow cable guide which laterally offsets the buss cables of the bow from the bow string to allow the arrow and arrow fletching to leave the bow without hitting the buss cables can be mounted on the reinforcing riser section and, because of this, can be positioned closer to the center of the bow, i.e., the location of the arrow when nocked in the bow, than otherwise would be the case. This means that the buss cables do not have to be moved as far laterally as is the case when the cable guide is spaced farther from the center of the bow. This closer spacing results in less torque placed on the cable guide and the accuracy and shootability of the bow is increased.

The arrow shelf of the riser preferably also includes an integrally formed flange along its edge. This replaces an extra flange sometimes added to an arrow shelf as a separate component, usually as part of an added, separate overdraw. The added flange makes it more difficult for an arrow on the arrow shelf to slide off the shelf.

DRAWINGS

The best mode presently contemplated for carrying out the invention is illustrated in the accompanying drawings, in which:

FIG. 1 is a side elevation of an archery bow including the riser of the invention;

FIG. 2, a rear elevation (the side of the riser facing away from the archer) of the riser of the invention taken on the line 2—2 of FIG. 1, without the bow limbs or limb pockets;

FIG. 3, a front elevation (the side of the riser facing toward the archer) of the riser taken on the line 3—3 of FIG. 1, again without the bow limbs or limb pockets;

FIG. 4, a transverse section through the sight window portion of the riser above the arrow shelf taken on the line 4—4 of FIG. 1, and showing the arrow shelf in top plan view; and FIG. 5, a fragmentary perspective view of the riser showing the arrow shelf.

DETAILED DESCRIPTION OF THE ILLUSTRATED EMBODIMENT

Figure 1:
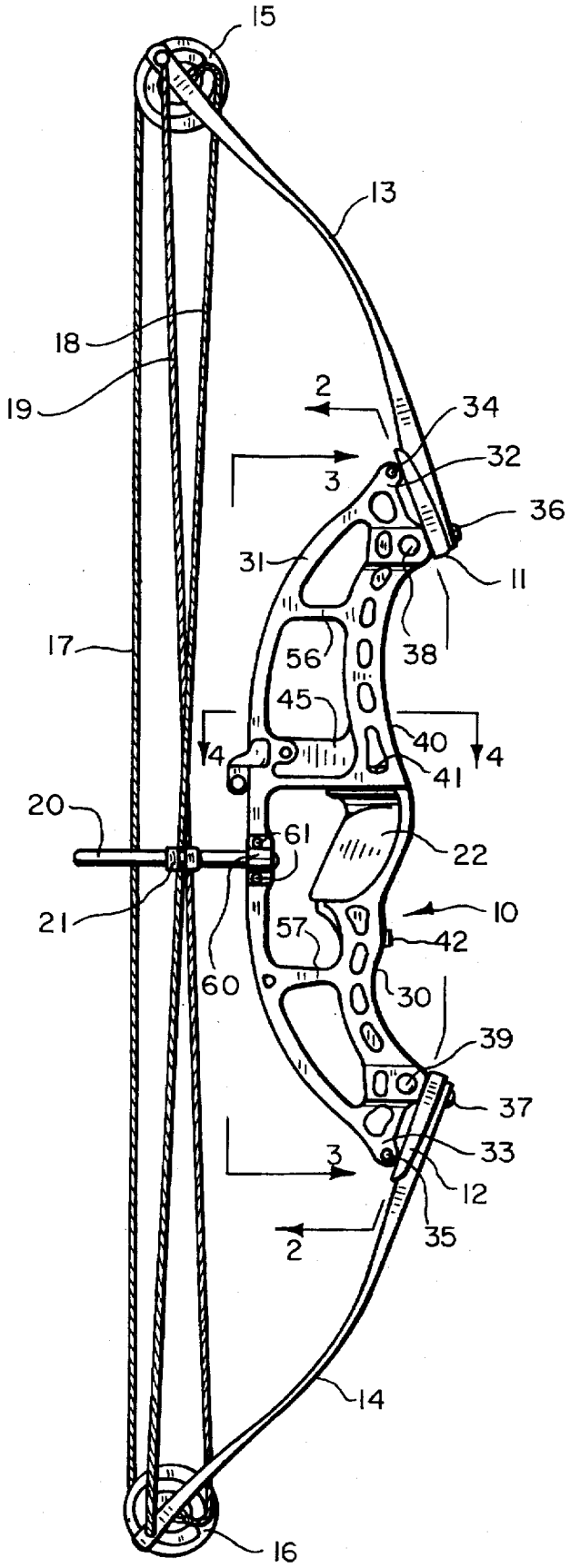

An archery bow generally includes a handle riser 10, FIG. 1, with means, here shown as upper and lower limb mounting pockets 11 and 12, respectively, to mount upper and lower limbs 13 and 14, respectively, to the respective ends of the handle riser 10. In a compound archery bow, wheels 15 and 16 are mounted for eccentric rotation at the ends of limbs 13 and 14, respectively, with bow string 17 extending between wheels 15 and 16. Buss cables 18 and 19 extend between respective wheels and opposite limb tips. A cable guide 20 extends from attachment to riser 10 with a cable retaining member 21 slidably mounted thereon. An archer grips the handle riser around a hand grip portion 22 formed in or secured to the handle riser 10. This, except for the specific riser shown in FIG. 1, is representative of standard compound archery bow construction. A recurve bow may be similarly constructed, but would not have the wheels 15 and 16 mounted on the ends of the limbs. Instead, a bow string is connected directly between respective outer limb tips.

The riser of the invention as shown in FIG. 1 has a main riser section 30 of configuration similar to a conventional bow riser, and a reinforcing riser 31 spaced toward the bow string of the bow or the archer from the main riser section. The principal difference between the main riser section of the riser of the invention and a conventional riser is that it is of somewhat lighter construction. Where a conventional riser is constructed to withstand all stresses put upon it by the limbs during operation of the bow, the lighter construction of the main riser portion of the riser of the invention is not built to alone withstand all such stresses. Apart from the lighter construction however, the main riser section of the riser of the invention has a similiar configuration to a conventional riser and includes the same features of a conventional riser. Thus, for the embodiment shown, main riser section 30 has opposite split ends 32 and 33 for pivotally mounting limb mounting pockets 11 and 12, respectively, as they would be mounted on a conventional riser to pivot about pivot pins 34 and 35. Weight bolts 36 and 37 threaded into dowel nuts 38 and 39 in conventional manner provide for pivotal adjustment of limb pockets 11 and 12, respectively, and hold limb pockets 11 and 12 in adjusted position. The main riser section includes a hand grip portion 22 which is gripped by the archer to hold the bow. It also includes a sight window portion 40 and arrow shelf 41, FIGS. 1, 2, 4, and 5. A stabilizer mounting bushing 42 is provided on the rear side of the main riser section below the handle portion 22. This allows the mounting of a stabilizer in normal manner to extend from the riser in a direction away from the archer.

Figure 5:
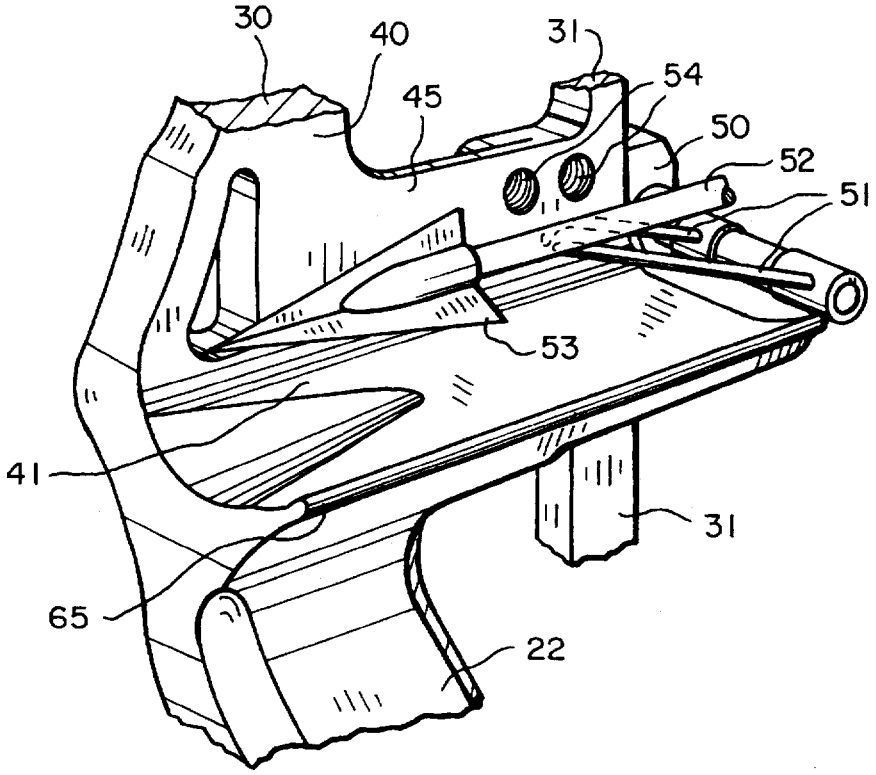

Reinforcing riser section 31 extends from one end of the main riser section to the other end of the main riser section spaced toward the bow string or archer from the main riser section. Thus, reinforcing riser section 31 is secured to and extends between main riser section ends 32 and 33. From attachment to the ends 32 and 33 of main riser section 30, reinforcing riser section 31 extends forwardly toward the bow string to space it from main riser section 30, and then generally parallels main riser section 30, but spaced toward the bow string therefrom. Main riser section 30 and reinforcing riser section 31 are connected intermediate their ends, i.e., intermediate their lengths, by connecting members extending between the sections so that each section reinforces the other and the two sections work together as an integral riser. The number of intermediate connections and their location and configuration will depend upon the overall design and requirements of specific risers, but particularly advantageous results are achieved if a connection is made in the area of the sight window and arrow shelf. Such connecting member is indicated at 45 in FIGS. 1 and 5. Connecting member 45 forms an extension of the lower portion of the sight window 40 and the arrow shelf 41 of the main riser section forwardly to the reinforcing riser section as shown best in FIGS. 4 and 5. This extension of the lower portion of the sight window and the arrow shelf provides an equivalent extension of the lower portion of the sight window and arrow shelf toward the bow string as does the attachment of an "overdraw" to a standard riser. Thus, with a connecting member positioned and configured as at 45, the riser of the invention provides a built in overdraw. A commercially available arrow rest 50 may be mounted to reinforcing riser section 31 to be positioned behind the extension of arrow shelf 41 with arrow supporting finger 51 extending over the end of the extension of arrow shelf 41 as shown in FIG. 5 to support arrow shaft 52 with broadhead 53 at the tip thereof over the extension of arrow shelf 41, or other commercially available arrow rests may be secured in standard fashion to threaded holes 54 to similarly support arrow shaft 52 and broadhead 53.

Additional connecting members 56 and 57 are preferably provided above and below, respectively, connecting member 45 for further connecting main riser section 30 and reinforcing riser section 31. The three connections 45, 56, and 57 have been found to provide good reinforcing action between the main and reinforcing riser sections to form a rigid overall riser. While for a particular embodiment of the riser of the invention it has been found that the overall riser weighs about two ounces more than a comparable conventional riser without an overdraw attachment, with the overdraw attachment weighing about five ounces, the riser of the invention is about three ounces less in weight than the comparable conventional riser with overdraw attached. In addition, the riser of the invention was found to be as rigid as, if not more rigid than, the comparable conventional riser.

Figure 2:
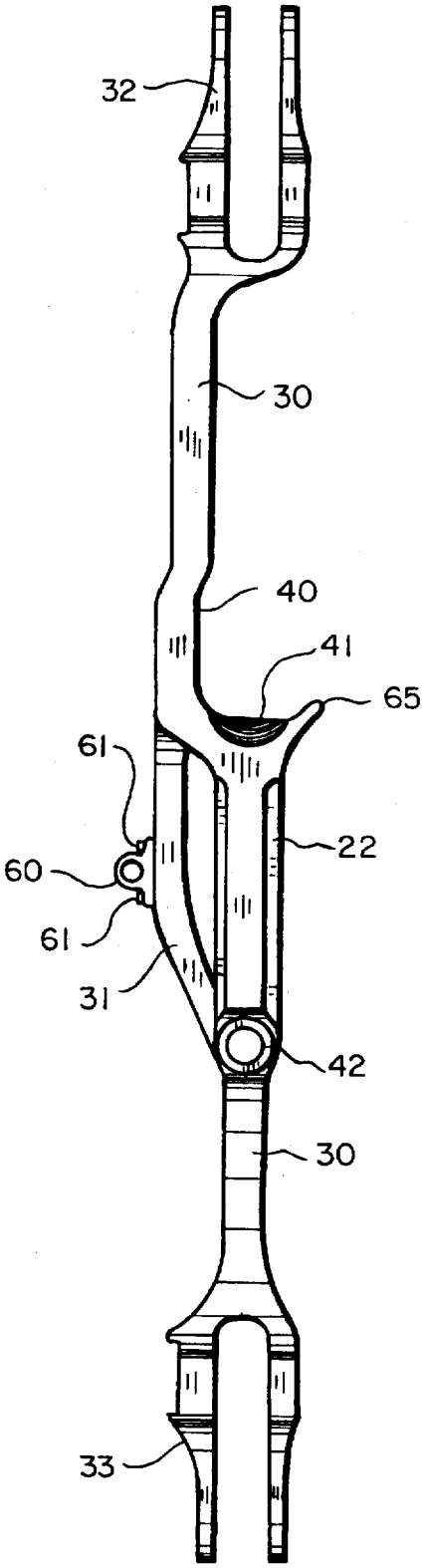
Figure 3:
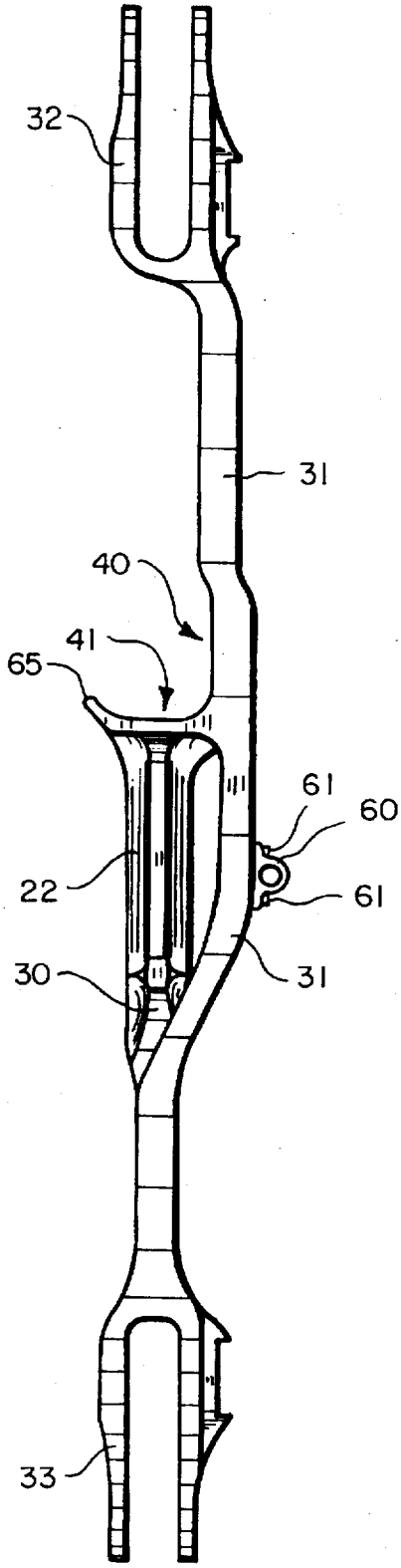
Figure 4:
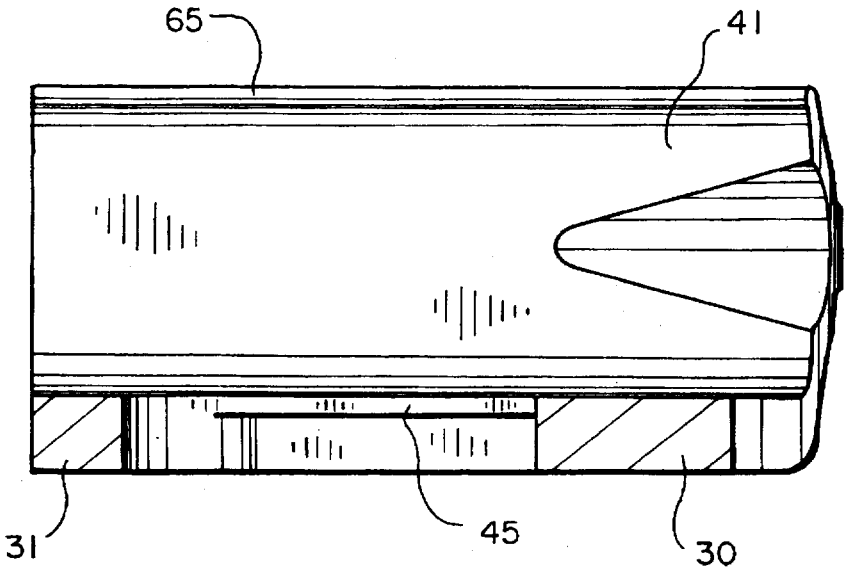

As can be seen in FIGS. 2 and 3, reinforcing riser section 31 is generally aligned with main riser section 30 except in the area of hand grip portion 22. In order to allow an archer to grasp hand grip portion 22 and hold the bow in normal manner, reinforcing riser section 31 is offset laterally from the main riser through the hand grip portion. Thus, while main riser hand grip portion 22 extends substantially vertically downwardly under arrow shelf 41 as shown in FIGS. 2 and 3, reinforcing riser 31 extends substantially vertically downwardly under the portion of main riser 30 forming sight window 40 and then angles toward the main riser section to again line up with the main riser section below hand grip portion 22. This lateral offset of the reinforcing riser section from the main riser section in the hand grip portion has the advantage of allowing mounting of the usual cable guide 20, FIG. 1, much closer to center of the riser, i.e., the position just above the arrow shelf 41 through which the arrow is positioned and shot, than with a conventional riser. With a conventional riser, the cable guide, which extends toward the bow string and the archer, interferes with the hand grip and with holding the bow unless it is positioned below the hand grip portion 22. Thus, with conventional risers, the cable guide is mounted on the riser below hand grip portion 22 at the approximate vertical location of the stabilizer mounting bushing 42 shown in FIG. 2, but on the opposite side of the riser. In FIG. 3, this is at approximately the vertical location where reinforcing riser section 31 lines up with main riser section 30 below hand grip portion 22. With the lateral offset of reinforcing riser section 31 from the hand grip portion 22 of the main riser section, mounting of cable guide 20 can be moved vertically upwardly to a position horizontally aligned with the hand grip portion 22 of the main riser section. Thus, as shown in FIGS. 1–3, cable guide mounting bracket 60 is secured to reinforcing riser section 31 by screws 61 at a vertical position just below about the middle of the hand grip portion 22. This is much closer to arrow shelf 41 than with a conventional mounting and means that the cables do not have to be held as far to the side of the bow string to provide the same lateral clearance between the bow string and buss cables for an arrow being shot from the bow as with a lower placement of the cable guide. This results in less torque on the cables and the cable guide than with conventional placement and increases the forgiveness, accuracy, and shootability of the bow. The cable guide cannot be moved all of the way up to arrow shelf 41 because room has to be provided for an archer to "let down" the bow, i.e., return the bow string to brace position from a drawn position without releasing the bow string, without the archer's hand hitting the cable guide. Thus, the cable guide should be positioned below the vertical position of an archer's hand when holding the bow string to draw the bow.

It is preferred in many instances to provide a lip 65 along the outer edge of arrow shelf 41. Such a lip is sometimes added to a riser's arrow shelf by an overdraw attachment. However, in the present riser, it is presently preferred to include such lip as an integral part of the arrow shelf.

The riser of the invention is preferably formed as a unitary riser of single piece construction. The riser can be machined from a piece of aluminum, preferably an aluminum extrusion having the basic lateral shape of the riser as shown in FIGS. 2 and 3, including the arrow shelf lip 65, and having a sufficient width through the handle section to include both the main riser section and the reinforcing riser section. The riser could also be machined from a block of aluminum or magnesium or be cast from a metal such as magnesium or aluminum.

While various details of the riser have been shown in the drawings, such as the split ends on the riser and the lip on the arrow shelf, these details could be changed to any desired configuration. Many bow risers do not have the illustrated split ends, and the ends of a riser of the invention could be made with solid ends adapted for mounting of a pocket on the outside of the ends or for direct attachment of the limbs to the riser ends. Further, various configurations of cut-outs through the riser to divide the riser sections and through the riser sections to reduce riser weight can be utilized. A basic aspect of the invention is the provision of a main riser section and reinforcing riser section spaced toward the bow string from the main riser section with the lower portion of the sight window and the arrow shelf extending between the two sections to provide a strong and rigid riser with, in effect, a built-in "overdraw".

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. An archery bow riser comprising:

an elongate main riser section having opposite ends adapted to have bow limbs attached thereto to extend outwardly therefrom, the main riser section having a handle portion, a sight window, and an arrow shelf intermediate its length;

a reinforcing riser section attached to and extending between the opposite ends of the main riser section and spaced from the main riser section, said reinforcing riser section being laterally offset from the handle portion of the main riser section; and at least one connecting member extending between the main riser section and the reinforcing riser section intermediate their lengths so that each section reinforces the other.

2. An archery bow riser according to claim 1, wherein a portion of the sight window of the main riser section is adjacent the arrow shelf, and wherein one of the at least one connecting member forms an extension of the arrow shelf and the portion of the sight window immediately adjacent the arrow shelf from the main riser section to the reinforcing riser section.

3. An archery bow riser according to claim 2, wherein the at least one connecting member is three connecting members.

4. An archery bow riser according to claim 3, wherein a connecting member is located between the connecting member forming the extension of the arrow shelf and each end of the riser.

5. An archery bow riser according to claim 2, wherein the arrow shelf has an edge away from the sight window, including a lip along the edge of the arrow shelf formed integrally with the arrow shelf.

6. An archery bow riser according to claim 1, wherein means is provided for mounting a cable guide to the reinforcing riser section along the portion thereof laterally offset from the handle portion of the main riser.

7. An archery bow riser comprising:

an elongate main riser section having opposite ends adapted to have bow limbs attached thereto to extend outwardly therefrom, the main riser section having a handle portion, a sight window, and an arrow shelf intermediate its length, a portion of the sight window being adjacent the arrow shelf;

a reinforcing riser section attached to and extending between the opposite ends of the main riser section and spaced from the main riser section, the arrow shelf and the portion of the sight window immediately adjacent the arrow shelf extending from the main riser section to the reinforcing riser section to connect the main riser section and the reinforcing riser section so that each section reinforces the other; and at least two connecting members extending between the main riser section and the reinforcing riser section intermediate their lengths so that each section reinforces the other.

8. An archery bow riser according to claim 7, wherein a connecting member is located between the arrow shelf and each end of the riser.

9. An archery bow riser according to claim 8, wherein the reinforcing riser section is laterally offset from the handle portion of the main riser section.

10. An archery bow riser according to claim 9, wherein means is provided for mounting a cable guide to the reinforcing riser section along the portion thereof laterally offset from the handle portion of the main riser.

11. An archery bow riser according to claim 10, wherein the arrow shelf has an edge away from the sight window, including a lip along the edge of the arrow shelf formed integrally with the arrow shelf.

12. An archery bow riser according to claim 7, wherein the reinforcing riser section is laterally offset from the handle portion of the main riser section.

13. An archery bow riser according to claim 12 wherein means is provided for mounting a cable guide to the reinforcing riser section along the portion thereof laterally offset from the handle portion of the main riser.

14. An archery bow riser comprising:

an elongate main riser section having opposite ends adapted to have bow limbs attached thereto to extend outwardly therefrom, the main riser section having a handle portion, a sight window, and an arrow shelf intermediate its length;

a reinforcing riser section attached to and extending between the opposite ends of the main riser section and spaced from the main riser section toward the bow string of the bow and separate from and spaced from the handle portion of the main riser section; and a connecting member extending between the main riser section and the reinforcing riser section so that each section reinforces the other, the connecting member forming an extension of the arrow shelf and the portion of the sight window immediately adjacent the arrow shelf from the main riser section substantially to the side of the reinforcing riser section toward the bow string to form an overdraw for the riser as an integral part thereof.

15. An archery bow riser according to claim 14, including two additional connecting members, each additional connecting member being located between the arrow shelf and an opposite end of the riser.

* * * * *